US005750440A

United States Patent [19]

Vanell et al.

[11] Patent Number: 5,750,440

[45] Date of Patent: May 12, 1998

[54] APPARATUS AND METHOD FOR DYNAMICALLY MIXING SLURRY FOR CHEMICAL MECHANICAL POLISHING

[75] Inventors: James F. Vanell, Tempe; Steven D. Ward, Phoenix, both of Ariz.; James M. Mullins, Austin, Tex.

[73] Assignee: Motorola, Inc., Schaumburg, Ill.

[21] Appl. No.: 559,669

[22] Filed: Nov. 20, 1995

[51] Int. Cl.[6] ..... B24B 57/04; B24B 1/00

[52] U.S. Cl. ..... 438/692; 156/345; 216/88; 216/89; 366/154.1; 366/162.1

[58] Field of Search ..... 156/345, 636.1, 156/640.1; 216/88, 89, 92; 134/36

[56] References Cited

U.S. PATENT DOCUMENTS

| | | | |
|---|---|---|---|
| 4,059,929 | 11/1977 | Bishop | 51/263 |
| 4,242,841 | 1/1981 | Ushakov et al. | 51/263 |
| 4,439,042 | 3/1984 | Bertoglio | 366/154 |
| 5,407,526 | 4/1995 | Danielson et al. | 156/636.1 |
| 5,478,435 | 12/1994 | Murphy et al. | 156/636.1 |
| 5,584,959 | 8/1994 | Kimura et al. | 156/345 |

*Primary Examiner*—R. Bruce Breneman
*Assistant Examiner*—Michael E. Adjodha
*Attorney, Agent, or Firm*—George C. Chen

[57] ABSTRACT

An apparatus and a method of dynamically mixing a slurry for a chemical mechanical polish includes pumping an abrasive (33) and an oxidizer (37) into a first portion (19) of a slurry mixer (11), using a magnetically coupled stirrer (17) to blend the abrasive (33) and the oxidizer (37) into a slurry (41) in the first portion (19) of the slurry mixer (11), transporting the slurry (41) through a diffuser (21) and into a second portion (22) of the slurry mixer (11), keeping the slurry (41) in the second portion (22) of the slurry mixer (11) for a residence time, and, subsequently, using the slurry (41) to chemical mechanical polish a semiconductor substrate (43). The diffuser (21) reduces air entrainment of the slurry (41), and the residence time enables the slurry (41) to be used when it has a maximum polishing rate.

23 Claims, 2 Drawing Sheets

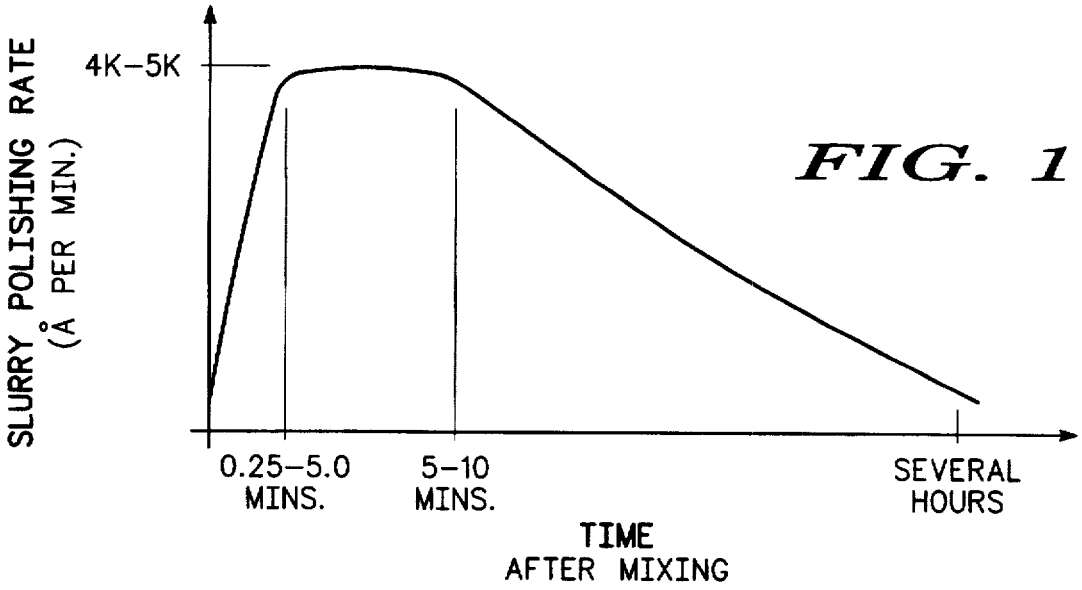
FIG. 1
FIG. 2
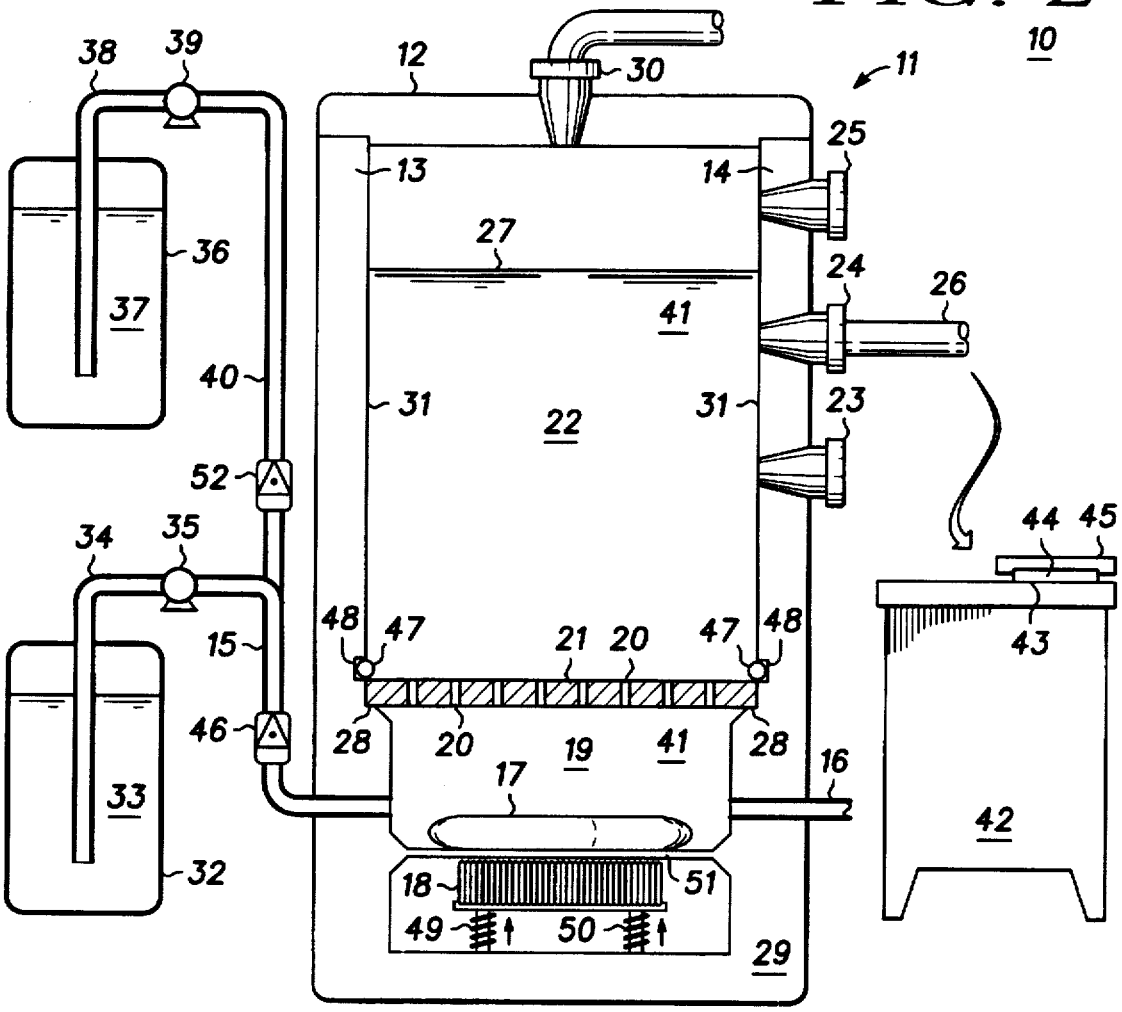

APPARATUS AND METHOD FOR DYNAMICALLY MIXING SLURRY FOR CHEMICAL MECHANICAL POLISHING

BACKGROUND OF THE INVENTION

This invention relates, in general, to fabricating semiconductor components, and more particularly, to dynamically mixing chemicals for fabricating semiconductor components.

Chemical mechanical polish (CMP) techniques are used to planarize metals, dielectrics, and other materials used to fabricate semiconductor components. When planarizing metals, an abrasive and an oxidizer are mixed together to form a slurry. The slurry is used to chemically and mechanically polish, etch, or passivate the metal. The abrasive is a colloidal solution containing particles that are electrically charged. The electrical charge holds the particles in suspension within the abrasive. However, when the abrasive mixes with the oxidizer, a chemical reaction removes the electrical charge from the particles, which fall out of suspension and agglomerate within the slurry.

In CMP batch systems, large amounts of slurry are premixed in 100–10,000 liter tanks, which are referred to as day tanks because they provide enough slurry to polish wafers for an entire day. However, day tanks suffer from settling issues due to the agglomeration within the slurry. Recirculation or stirring of the slurry in the day tanks only mildly relieves the settling issues. Furthermore, if the slurry is kept too long in the day tank, the reactivity of the slurry decreases, which reduces the polishing rate of the CMP process and which produces inconsistent polishing results. Consequently, old slurry is drained to a waste stream from the large day tanks and is wasted due to its relatively short optimal shelf-life.

In CMP systems that utilize point-of-use mixing, the slurry is mixed immediately before being used to polish a semiconductor substrate. However, the point-of-use mixing systems use passive mixing, which does not actively mix the slurry and which may not provide adequate mixing of the abrasive and the oxidizer. Consequently, the polishing results may not be repeatable. Furthermore, the initial reaction rate between the abrasive and the oxidizer varies from one batch of chemicals to another. As a result, when the slurry is immediately used to polish a semiconductor substrate, the polishing rate varies erratically between different batches of chemicals, which also produces inconsistent polishing.

Accordingly, a need exists for dynamically mixing slurry for chemical mechanical polishing. The dynamic mixing should be manufacturable and cost-effective and should not significantly increase the cycle time of fabricating a semiconductor component.

BRIEF DESCRIPTION OF THE DRAWINGS

FIG. 1 illustrates a graph of a slurry polishing rate versus time in accordance with the present invention;

FIG. 2 portrays a cross-sectional schematic view of a chemical mechanical polisher in accordance with the present invention.

DETAILED DESCRIPTION OF THE DRAWINGS

Figure 3:
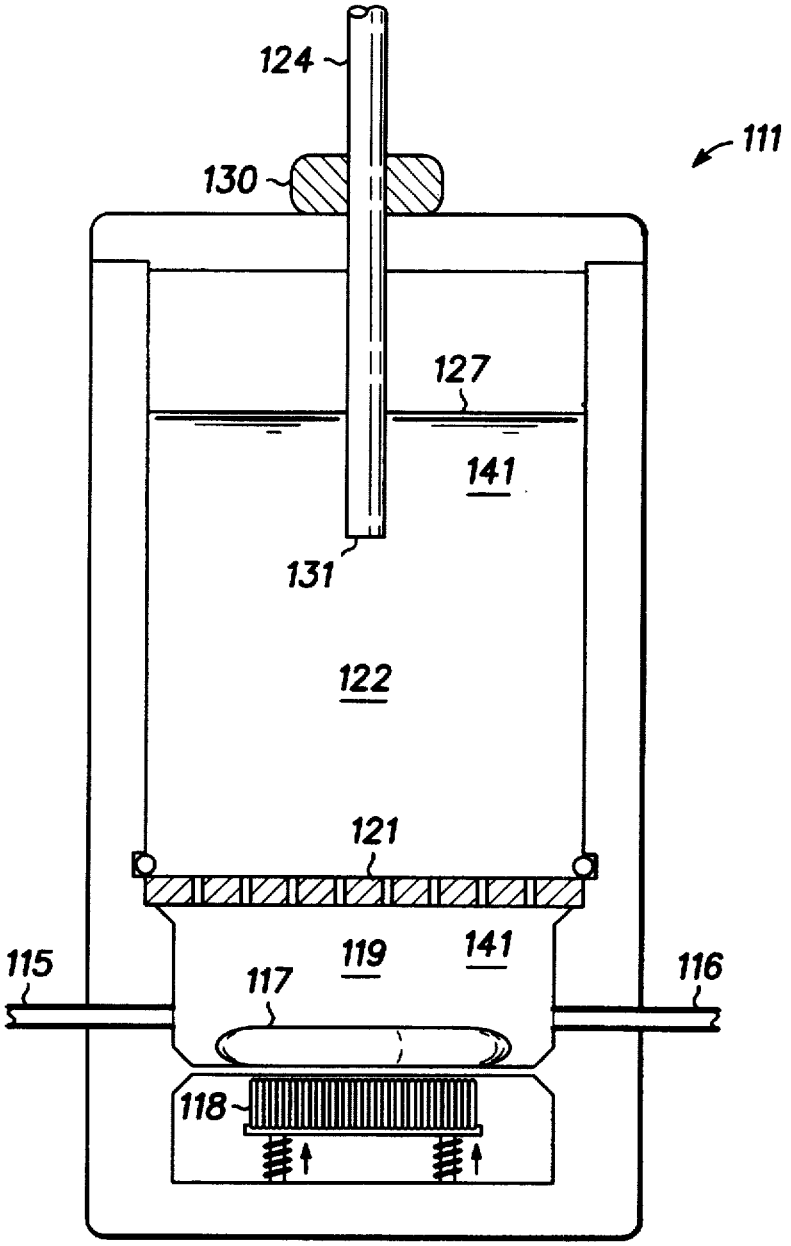
FIG. 3 depicts a cross-sectional schematic view of an alternative embodiment of a slurry mixer in accordance with the present invention.

Turning to the figures for a more detailed description, FIG. 1 shows a graph of a slurry polishing rate versus time to illustrate a problem that the present invention solves. The ordinate or Y-axis represents the slurry polishing rate of a chemical mechanical polish (CMP) process while the abscissa or X-axis represents the time after mixing of the slurry in the CMP process. As portrayed in FIG. 1, the slurry polishing rate increases after mixing of an abrasive and an oxidizer for a chemical mechanical polish slurry.

When polishing metals, the abrasive preferably comprises a colloidal solution containing electrically charged alumina, silica, cerium oxide particles or the like held in suspension within the colloidal solution. Also when polishing metals, the oxidizer preferably comprises ferric nitrate, deionized water, potassium iodate, hydrogen peroxide, or potassium ferricyanide, among other suitable chemistries.

However, when polishing dielectrics or materials other than metals, the abrasive preferably comprises a colloidal solution containing electrically charged silica particles or the like held in suspension within the colloidal solution. Furthermore, when polishing dielectrics, an oxidizer is not typically used. While the term "oxidizer" is used in the following description of the present invention, it is understood that when polishing a non-metallic material, other chemicals such as, for example, ammonia, ammonium hydroxide, or potassium hydroxide can be substituted for the oxidizer.

As mentioned above and as depicted in FIG. 1, the slurry polishing rate increases after mixing the abrasive and the oxidizer to form the slurry. During this increase in polishing rate, the abrasive and the oxidizer chemically react with each other. One of the chemical reactions produces flocculation of the slurry, which increases the size of the abrasive particles in the slurry. During flocculation, the abrasive particles lose their electric charge, begin to agglomerate, and increase in size, preferably from approximately 200–800 nanometers to 1–3 microns in diameter.

Also portrayed in the illustrated embodiment of FIG. 1, the slurry polishing rate reaches a maximum rate about fifteen seconds to five minutes after mixing. The illustrated embodiment also depicts the slurry polishing rate beginning to decrease about five to ten minutes after mixing. In a preferred embodiment, the maximum polishing rate is approximately 4,000 to 5,000 angstroms (Å) per minute and noticeably decreases by about five to ten percent after approximately ten minutes from the mixing of the abrasive and the oxidizer. The decrease in polishing rate is partially due to the natural loss of the reactivity of the oxidizer. The slurry polishing rate continues to decrease for several hours or even several days. Accordingly, in a preferred embodiment, the slurry is used to polish, etch, or erode a semiconductor substrate within thirty minutes from mixing of the abrasive and oxidizer.

One of average skill in the art will understand that the actual times required for the flocculation to stabilize, for the slurry polishing rate to reach a maximum, and for the slurry polishing rate to begin to decrease can vary from the times listed above. The variation is due to various factors including, but not limited to, the amount of agitation used to mix the slurry, the batch-to-batch variation of the abrasive and the oxidizer, temperature, and the specific chemical composition of the abrasive and the oxidizer used to create the slurry. Consequently, it is understood that the present invention is not limited to the approximate times illustrated in FIG. 1 or to the approximately times listed in the preceding paragraphs.

Considering the graph of FIG. 1, many disadvantages of the prior art CMP techniques are noted. In CMP batch systems where large amounts of slurry are premixed in day tanks, the slurry flocculates, and the abrasive particles precipitate on the bottom and on the sides of the day tank. Furthermore, prolonged flocculation in day tanks produces overly-large particles that can scratch a semiconductor substrate during the chemical mechanical polishing process.

In addition to the precipitate or particulate problem, the polishing rate of the slurry also varies depending upon whether the slurry is used two hours or ten hours after it is mixed. In a point-of-use passive mixer, the slurry is used while the polishing rate is still increasing and while the abrasive particles are still flocculating. Both factors vary the polishing rate. Furthermore, passive mixing may not adequately mix the abrasive and the oxidant, which produces additional variation in the polishing rate. An example of passive mixing occurs when, for example, the abrasive and oxidant are sprayed into a chamber to mix the two reactants.

Dynamic or mechanical mixing is a more thorough and complete mixing technique compared to passive mixing. Unlike passive mixing, dynamic mixing permits independent control of the mixing speed versus the flow rate of the abrasive and the oxidizer. As practiced in the present invention, an embodiment of dynamic mixing is illustrated in FIG. 2, which portrays a cross-sectional schematic view of a chemical mechanical polisher in accordance with the present invention.

An apparatus 10 portrays a chemical mechanical polisher. It is understood that apparatus 10, hereinafter referred to as chemical mechanical polisher 10, is highly simplified. It is further understood that chemical mechanical polisher is not drawn to scale in order to facilitate the description of the present invention. For instance, in a preferred embodiment, chemical mechanical polisher 10 includes a sealed cylindrical container or slurry mixer 11, supply tanks or reservoirs 32 and 36, pumps 35 and 39, check valves 46 and 52, a carrier assembly 45 supporting a semiconductor substrate 43, and a polishing surface, polishing pad, or platen 42. Slurry mixer 11 holds a volume of approximately 300 milliliters (ml) and has exterior dimensions of approximately 19 centimeters (cm) in height and 14 cm in diameter. However, reservoir 32 that supplies a chemical 33 to slurry mixer 11 has a preferred volume of approximately 100–1,000 liters. Therefore, although slurry mixer 11 is depicted as being larger than reservoir 32, it is understood that, in actuality, slurry mixer 11 is much smaller than reservoir 32. Due to its small size, slurry mixer 11 can be mounted in-line with existing slurry chemistry plumbing.

Slurry mixer 11 has a lid 12, side walls 13 and 14, and interior walls 31. In a preferred embodiment, lid 12 comprises an optically transparent material such as, for example, polyvinyl chloride so that the contents within slurry mixer 11 can be observed from the outside. Slurry mixer 11 can have the shape of a pyramid, a box, or other configurations but preferably has a cylindrical shape. In accordance with the present invention, an oxidizer and an abrasive are combined, mixed, or blended together to produce a mixture or slurry 41 inside slurry mixer 11.

Interior walls 31 of slurry mixer 11 are comprised of a material 29 that is not significantly etched or eroded by slurry 41. Examples of such materials include, for example, polytetrafluoroethylene resins, fluoropolymers, or other similar materials. In a preferred embodiment, interior walls 31 are comprised of an inexpensive slurry-resistant polymer such as, for example, polypropylene. In another preferred embodiment, side walls 13 and 14 are also comprised of polypropylene. Interior walls 31 are preferably smooth to reduce the probability of an abrasive particle in slurry 41 adhering or forming a residue or precipitate on interior walls 31.

As described above, reservoir 32 contains chemical 33. Another container or reservoir 36 contains a chemical 37. Reservoir 32 and chemical 33 are coupled to slurry mixer 11 through a tube 34, which is coupled to pump 35, which is coupled to an input 15 of slurry mixer 11. Similarly, reservoir 36 and chemical 37 are coupled to slurry mixer 11 through a tube 38, which is coupled to pump 39, which is coupled to an input 40 of slurry mixer 11. Pumps 35 and 39 can be pressurized nitrogen systems, diaphragm pumps, peristaltic pumps, or other appropriate pumps used in the art. In a preferred embodiment, pumps 35 and 39 each operate at a pressure of approximately 6 to 11 kilopascals and at a rate of approximately 50–500 ml per minute.

Inputs 15 and 40 are preferably not directly connected to each other, but instead, are both coupled to a portion 19 of slurry mixer 11. The section of input 40 that couples reservoir 36 to portion 19 is located behind input 15 and, therefore, is not portrayed in FIG. 2. Although not depicted, it is understood that more than two chemicals can be coupled to portion 19 of slurry mixer 11 in accordance with the present invention. For instance, additional reservoirs containing chemicals for setting a pH level, for increasing the polishing rate, or for increasing the uniformity of the chemical mechanical polish can also be coupled to portion 19 of slurry mixer 11 and added to slurry 41. In a preferred embodiment, chemical 33 represents an abrasive, and chemical 37 represents an oxidizer. Accordingly, chemical 33 is referred to as abrasive 33, and chemical 37 is referred to as oxidizer 37 in the balance of the detailed description below.

Inputs 15 and 40 contain check valves 46 and 52, respectively. Check valve 46 prevents slurry 41 in portion 19 from flowing back into input 15 toward pump 35 and reservoir 32. Similarly, check valve 52 prevents slurry 41 from backflowing out of portion 19 and into input 40 toward pump 39 and reservoir 36. Eliminating backflow of slurry 41 into inputs 15 and 40 prevents contamination, residue, or precipitate from forming in and clogging inputs 15 and 40. Check valves 46 and 52 are most effective when positioned as close to slurry mixer 11 as possible.

Abrasive 33 and oxidizer 37 are blended together within portion 19 of slurry mixer 11 by a mechanical mixing structure or magnetically coupled stirrer 17. Magnetically coupled stirrer 17 is preferably comprised of a polytetrafluoroethylene resin (e.g. TEFLON®) coating molded around a ferromagnetic core. Magnetically coupled stirrer 17 is located above an electromagnetic mixer 18 that generates a rotating magnetic field. The rotating magnetic field spins or rotates magnetically coupled stirrer 17 within portion 19 to mix or blend abrasive 33 and oxidizer 37 together to form slurry 41. In a preferred embodiment, magnetically coupled stirrer 17 has a shape of the letter "X," wherein the tines of the "X" are parallel to the bottom surface of portion 19 of slurry mixer 11. In an alternative embodiment of the present invention, magnetically coupled stirrer 17 has a shape of an oblong pill or tablet and has a length and height that is only slightly smaller than the length and height of portion 19 of slurry mixer 11. Additionally, a sensor can be used to measure the rate at which magnetically coupled stirrer 17 is spinning or rotating.

In a preferred embodiment, magnetically coupled stirrer 17 is supported by a bottom surface or portion 51 of slurry mixer 11. Portion 51 is thin to permit the magnetic field generated by electromagnetic mixer 18 to penetrate through portion 51 and into portion 19 of slurry mixer 11. However, because portion 51 is thin, portion 51 can deform or deflect downward in response to the pressure created by pumps 35 and 39. Therefore, coils or springs 49 and 50 support electromagnetic mixer 18 against a lower surface of portion 51 to support portion 51 and to prevent the deformation of portion 51.

Preferably, portion 19 also contains a valved port or drain 16 that is used to drain slurry 41 from slurry mixer 11. Slurry mixer 11 is drained in order to clean the inside chamber. The cleaning of slurry mixer 11 can be facilitated, for example, by installing nozzles (not shown) within slurry mixer 11 to spray deionized water or other cleaning agents within slurry mixer 11 to remove any residues that may have formed on interior walls 31 or diffuser 21. In a preferred embodiment where slurry mixer 11 has a volume of 50–500 ml, the draining of slurry mixer 11 wastes much less slurry than the large 100–10,000 liter prior art day tanks.

In a preferred embodiment, drain 16 is positioned above portion 51 of slurry mixer 11. Therefore, even when slurry mixer 11 is cleaned and flushed with deionized water, portion 19 of slurry mixer 11 will not drain completely empty. Due to the raised position of drain 16, some of the deionized water will remain in portion 19 to lubricate magnetically coupled stirrer 17 and portion 51.

A perforated plate, grating, or diffuser 21 is located between portion 19 and a portion 22 of slurry mixer 11 to separate portion 19 from a portion 22. Diffuser 21 contains holes 20 that couple portions 19 and 22 of slurry mixer 11. In a preferred embodiment, portion 19 of slurry mixer 11 has a volume of approximately 20 to 50 ml while portion 22 has a volume of approximately 100 to 500 ml. In another preferred embodiment, diffuser 21 has approximately 50–200 holes 20, each of which are about 0.5–3 millimeters in diameter. It is noted that the diameter of holes 20 must be larger than the diameter of the abrasive particles in slurry 41.

Diffuser 21 is preferably supported within slurry mixer 11 by steps 28 in interior walls 31 and is preferably held in place by a clamp or o-ring 47. O-ring 47 is positioned in notches 48 and prevents diffuser 21 from floating or from being pushed upwards into portion 22. O-ring 47 is preferably comprised of a fluoroelastomer.

As additional quantities of abrasive 33 and oxidizer 37 are pumped or injected into portion 19 of slurry mixer 11, the amount of slurry 41 in portion 19 increases, and the level of slurry 41 rises up toward perforated diffuser 21. Eventually, the volume of slurry 41 exceeds the volume of portion 19, and slurry 41 passes through holes 20 of diffuser 21 and is transferred or transported up and into portion 22 of slurry mixer 11. The purpose of diffuser 21 is to disrupt the agitation and to reduce the mixing of slurry 41 as it passes into portion 22. Magnetically coupled stirrer 17 forms a vortex of slurry 41 in portion 19. As slurry 41 passes through diffuser 21 and into portion 22, the vortex agitation pattern is disrupted. Continuously agitating slurry 41 increases air entrainment of slurry 41, which traps air within slurry 41 and decreases the efficiency of oxidizer 37. In other words, air entrainment within oxidizer 37 causes oxidizer 37 to lose its reactive oxidizing nature. Therefore, by reducing the amount of agitation, the slurry polishing rate will not decrease as quickly as compared to when slurry 41 is vigorously agitated, as is often done in the prior art.

Portion 22 of slurry mixer 11 contains an adjustable vacuum break or over-pressure port 30, which controls the internal pressure within slurry mixer 11 and which can be used to remove an overflow or an excess of slurry 41.

Portion 22 of slurry mixer 11 also contains outputs, outlet ports, or taps 23, 24, and 25 in side wall 14. Each of taps 23, 24, and 25 are arranged in a step function at a different height within side wall 14 to provide different levels at which slurry 41 can be drained from slurry mixer 11. In the illustrated embodiment, slurry 41 is at level 27, which is below tap 25 and above taps 23 and 24. Therefore, either tap 23 or 24 can be used to remove slurry 41 from slurry mixer 11.

In the illustrated embodiment of FIG. 2, tap 24 is used to remove slurry 41. The displacing action of incoming fresh oxidizer 37 and abrasive 33 in portion 19 forces slurry 41 out of portion 22 through tap 24. In a preferred embodiment where slurry mixer 11 has a volume of approximately 300 ml, tap 23 can begin draining slurry mixer 11 when slurry 41 is at a volume of about 50 ml; tap 24 can begin draining slurry mixer 11 when slurry 41 is at a volume of about 125 ml; and tap 25 can begin draining slurry mixer 11 when slurry 41 is at a volume of about 200 ml.

By providing varying heights or levels at which slurry 41 is drained, different amounts of delay are automatically introduced into the chemical mechanical polishing process in order to maximize the slurry polishing rate depicted in FIG. 1. For instance, if it takes two minutes to reach a maximum slurry polishing rate after mixing slurry 41, the delay created by slurry mixer 11 should be approximately two minutes. This delay or time period is also called a dwell time or a residence time. If the flow rates of oxidizer 37 and abrasive 33 into slurry mixer 11 are constant and if tap 23 is used to drain slurry 41 from slurry mixer 11, a shorter residence time would result compared to the illustrated embodiment of FIG. 2 where tap 24 is used to drain slurry 41. Similarly, if tap 25 is used, a longer residence time would result compared to when tap 24 is used. The varying amounts of residence time depend upon numerous factors including, but not limited to, the specific chemistries of oxidizer 37 and abrasive 33, the magnitude of agitation provided by magnetically coupled stirrer 17, the volume of slurry mixer 11, and the effectiveness of diffuser 21.

Diffuser 21 stratifies or layers slurry 41 within slurry mixer 11 and ensures that a proper residence time is maintained. Stratification prevents slurry 41 in portion 22 from being mixed by the vortex pattern in portion 19. If diffuser 21 were not used, all of slurry 41 in portions 19 and 22 would be mixed or agitated by the vortex pattern created by magnetically coupled stirrer 17. However, when all of slurry 41 is mixed, freshly mixed oxidizer 37 and abrasive 33 can flow immediately from inputs 15 and 40, respectively, up to tap 24 and out of slurry mixer 11. Consequently, slurry mixer 11 would not be able to consistently or reliably maintain a fixed residence time for slurry 41 without diffuser 21. Therefore, in accordance with the present invention, slurry mixer 11 should contain a device or should utilize a method that appropriately stratifies slurry 41.

The selection of which tap to use is also dependent upon the flow rates of oxidizer 37 and abrasive 33 into portion 19 of slurry mixer 11. For a specified residence time, faster flow rates would require the use of a higher tap, and slower flow rates would require the use of a lower positioned tap.

As illustrated in FIG. 2, tap 24 is coupled to a dispense bar 26, which dispenses slurry 41 onto polishing pad or platen 42. Although not depicted in FIG. 2, it is understood that tap 24 may not be directly connected to dispense bar 26, but instead, other structures can connect tap 24 to dispense bar 26. Supporting a plurality of semiconductor devices or semiconductor components 44, semiconductor substrate 43 is supported by carrier assembly 45 and is chemical mechanical polished by slurry 41 and platen 42 using conventional techniques.

Semiconductor substrate 43 contains layers of metals and dielectrics, both of which can be polished by different embodiments of slurry 41. The surface of semiconductor substrate 43 that faces toward platen 42 is the surface that is chemical mechanical polished. Those skilled in the art will understand that carrier assembly 45 forces semiconductor substrate 43 against platen 42 and slurry 41 during the chemical mechanical polish. An example of such a carrier assembly and platen combination can be found in a Westech chemical mechanical polisher, model number 472M, available from IPEC-WESTECH of Phoenix, Ariz.

During the chemical mechanical polishing of semiconductor substrate 43, slurry 41 is preferably applied to platen 42 at room temperature while semiconductor substrate 43 is preferably heated to an elevated temperature. However, in an alternative embodiment, slurry 41, semiconductor substrate 43, and platen 42 may be either heated or cooled.

Referring now to the next figure, FIG. 3 depicts a cross-sectional schematic view of an alternative embodiment of a slurry mixer in accordance with the present invention, generally designated 111. Slurry mixer 111 is similar to slurry mixer 11 of FIG. 2. Accordingly, slurry mixer, container, or chamber 111 includes an input 115, a drain 116, a stirrer 117, and an electromagnetic mixer 118, which are similar to slurry mixer 11, input 15, drain 16, magnetically coupled stirrer 17, and electromagnetic mixer 18, respectively, of FIG. 2. Likewise, a lower portion 119, an upper portion 122, slurry 141, and a perforated diffuser 121 of FIG. 3 are similar to portion 19, portion 22, slurry 41, and diffuser 21, respectively, of FIG. 2.

A tap or output 124 of FIG. 3 is similar in function to taps 23, 24, and 25 of FIG. 2, but output 124 is adjustable in height while the heights of taps 23, 24, and 25 are not adjustable in height. The height of output 124 in FIG. 3 is modified by a height adjuster 130 to provide a more precise residence time for slurry 141 compared to the fixed positions of taps 23, 24, and 25 in FIG. 2. Slurry 141 can be retained or kept within chamber 111 for a longer residence time by raising output 124, which moves output 124 further away from portion 119. Similarly, slurry 141 can be retained within chamber 111 for a shorter residence time by lowering output 124, which moves output 124 closer to perforated diffuser 121. The use of an adjustable output or adjustable tap increases the flexibility of chamber 111. Similar to tap 24, output 124 is also coupled to a slurry dispense bar (not shown).

In a preferred embodiment, a pump is not required to extract slurry 141 out of portion 122 through output 124. Prior to pumping oxidizer or abrasive into chamber 111, chamber 111 contains air. Because chamber 111 is sealed, pumping oxidizer and abrasive into chamber 111 increases the pressure within chamber 111. When a level 127 of slurry 141 is below an end 131 of output 124, the increased pressure forces air out of chamber 111 through output 124. When level 127 of slurry 141 reaches or exceeds end 131 of output 124, air can no longer be forced out of output 124. Instead, the excess pressure forces or displaces slurry 141 out of output 124 and onto a platen (not shown) for chemical mechanical polishing. As long as end 131 of output 124 is below level 127 of slurry 141 and as long as chamber 111 is sealed, chamber 111 can dispense slurry 141 without using a pump to extract slurry 141 out of output 124.

In another embodiment of the present invention, nitrogen, argon, or other inert gases can be injected into chamber 111 to displace the air in chamber 111. By filling chamber 111 with an inert gas, air entrainment of slurry 141 is reduced.

While the invention has been particularly shown and described with reference to preferred embodiments, it will be understood by those skilled in the art that changes in form and detail can be made without departing from the spirit and scope of the invention. For instance, the above invention can be used to mix any number of chemicals or can be used to dilute a chemical with one or several other chemicals. As an example, a concentrated slurry can be diluted with deionized water using the slurry mixer of the present invention. Additionally, while magnetically coupled stirrers 17 and 117 are used to mix the chemicals of the preferred embodiments, one skilled in the art will recognize that other dynamic blending or mixing techniques can be substituted for the illustrated magnetic technique. However, regardless of the specific mixing apparatus employed, the chemicals used during the mixing process should not significantly etch, erode, corrode, or otherwise destroy the mixing apparatus.

Therefore, in accordance with the present invention, it is apparent there has been provided an improved apparatus and method for dynamically mixing slurry for chemical mechanical polishing that overcomes the disadvantages of the prior art. The present invention is manufacturable, is cost-effective, maximizes the slurry polishing rate for different types of slurry, and does not significantly increase the cycle time of a fabricating a semiconductor component. The present invention is also compatible for use in a cleanroom environment, prevents air entrainment of the slurry during the residence time, provides over-pressure control within a slurry mixer, and is small in size to facilitate in-line mounting with existing plumbing of a chemical mechanical polisher.

What is claimed is:

1. A method of dynamically mixing slurry for chemical mechanical polishing, the method comprising the steps of:

providing an oxidizer, an abrasive, and a slurry mixer;

dispensing the oxidizer and the abrasive into the slurry mixer;

dynamically blending the oxidizer and the abrasive together to form the slurry in the slurry mixer;

retaining the slurry in the slurry mixer for a time period of less than approximately thirty minutes;

subsequently, removing the slurry from the slurry mixer; and dispensing the slurry onto a polishing surface.

2. A method of dynamically mixing slurry for chemical mechanical polishing, the method comprising the steps of:

providing an oxidizer, an abrasive, and a slurry mixer;

dispensing the oxidizer and the abrasive into the slurry mixer;

dynamically blending the oxidizer and the abrasive together to form the slurry in the slurry mixer;

stratifying the slurry in the slurry mixer, wherein the step of providing the slurry mixer includes providing a slurry mixer comprised of polypropylene, wherein interior walls of the slurry mixer are smooth;

retaining the slurry in the slurry mixer for a time period of less than approximately thirty minutes;

subsequently, removing the slurry from the slurry mixer; and dispensing the slurry onto a polishing surface.

3. The method according to claim 1, wherein the step of retaining the slurry in the slurry mixer includes reducing air entrainment of the slurry.

4. A method of dynamically mixing slurry for chemical mechanical polishing, the method comprising the steps of:

providing an oxidizer, an abrasive, and a slurry mixer;

dispensing the oxidizer and the abrasive into the slurry mixer;

dynamically blending the oxidizer and the abrasive together to form the slurry in the slurry mixer;

retaining the slurry in the slurry mixer for a time period of less than approximately thirty minutes;

subsequently, removing the slurry from the slurry mixer; and dispensing the slurry onto a polishing surface wherein the step of retaining the slurry in the slurry mixer includes providing a delay of approximately fifteen seconds to five minutes between the step of dynamically blending the oxidizer and the abrasive and the step of dispensing the slurry onto the polishing surface.

5. A method of dynamically mixing slurry for chemical mechanical polishing, the method comprising the steps of:

providing an oxidizer, an abrasive, and a slurry mixer;

dispensing the oxidizer and the abrasive into the slurry mixer;

dynamically blending the oxidizer and the abrasive together to form the slurry in the slurry mixer;

retaining the slurry in the slurry mixer for a time period of less than approximately thirty minutes;

subsequently, removing the slurry from the slurry mixer; and dispensing the slurry onto a polishing surface, wherein the step of removing the slurry from the slurry mixer includes using pressure generated from the step of dispensing the oxidizer and the abrasive into the slurry mixer to remove the slurry from the slurry mixer.

6. A method of manufacturing a semiconductor component, the method comprising the steps of:

mixing a first chemical and a second chemical into a mixture;

providing a residence time for the mixture, wherein the residence time is greater than approximately fifteen seconds and less than approximately thirty minutes; and dispensing the mixture after the residence time.

7. A method of manufacturing a semiconductor component, the method comprising the steps of:

mixing a first chemical and a second chemical into a mixture;

providing a residence time for the mixture, wherein the residence time is less than approximately thirty minutes; and dispensing the mixture after the residence time, wherein the step of mixing the first and second chemicals includes using a magnetically coupled stirrer in a first portion of a chamber separated from a second portion of the chamber by a grating, wherein the step of mixing the first and second chemicals includes mixing the first and second chemicals in the first portion of the chamber and wherein the step of dispensing the mixture includes dispensing the mixture from the second portion of the chamber.

8. A method of making an electronic device comprising:

providing a substrate;

providing a slurry;

transporting the slurry through a diffuser; and applying the slurry to the substrate after the transporting step.

9. A method of manufacturing a semiconductor component, the method comprising the steps of:

providing a container having a perforated diffuser between an upper portion and a lower portion;

providing a first reservoir having a chemical;

providing a second reservoir having an abrasive;

extracting the chemical from the first reservoir and into the lower portion of the container;

extracting the abrasive from the second reservoir and into the lower portion of the container;

combining the chemical and the abrasive into a mixture in the lower portion of the container;

transporting the mixture through perforated diffuser into the upper portion of the container;

keeping the mixture in the container for a time period; and thereafter, dispensing the mixture from the container through a tap.

10. The method according to claim 9, further comprising the step of chemical mechanical polishing the semiconductor component with the mixture after dispensing the mixture, wherein the step of providing the first reservoir includes providing the first reservoir having an oxidizer and wherein the step of combining the oxidizer and the abrasive includes combining the oxidizer and the abrasive into a slurry.

11. The method according to claim 9, wherein the step of combining the chemical and the abrasive includes using a magnetically coupled stirrer in the lower portion of the container and wherein the step of transporting the mixture includes transporting the mixture into the upper portion of the container by providing more of the chemical and the abrasive in the lower portion of the container.

12. The method according to claim 9, wherein the step of keeping the mixture in the container includes keeping the mixture in the container for a time period between approximately fifteen seconds and ten minutes and wherein the step of transporting the mixture through the perforated diffuser includes stratifying the mixture.

13. The method according to claim 9, wherein the step of dispensing the mixture through the tap includes providing a plurality of taps in the container, wherein each of the plurality of taps is located at a different height and wherein the mixture is dispensed through one of the plurality of taps.

14. The method according to claim 9, wherein the step of dispensing the mixture through the tap includes adjusting the height of the tap.

15. A method of manufacturing a semiconductor component comprising:

providing a substrate;

providing a slurry;

providing a perforated plate;

passing the slurry through the perforated plate; and chemical mechanical polishing the substrate with the slurry after the passing step.

16. The method of claim 15 further comprising mechanically agitating the slurry.

17. The method of claim 16 wherein the step of mechanically agitating the slurry includes mechanically agitating the slurry before passing the slurry through the perforated plate.

18. A method of manufacturing a semiconductor component comprising:

dynamically blending a slurry;

conducting the slurry through a diffuser; and thereafter, using the slurry to polish a substrate.

19. The method of claim 18 wherein the step of conducting the slurry occurs after the step of dynamically blending the slurry and before the step of using the slurry.

20. An apparatus for mixing chemicals, the apparatus comprising:

a container having an upper portion and a lower portion, the lower portion having a bottom surface;

a diffuser between the upper portion and the lower portion;

an input at the lower portion of the container;

a mixing structure in the lower portion of the container; and an output at the upper portion of the container.

21. The apparatus according to claim 20, further comprising:

a drain at the lower portion of the container, wherein the drain is positioned above the bottom surface; and a vacuum break at the upper portion of the container, wherein the container has a volume of approximately 50 to 500 milliliters, wherein the container comprises polypropylene, and wherein interior walls of the container are smooth.

22. The apparatus according to claim 20, wherein the mixing structure includes a magnetically coupled stirrer.

23. An apparatus for manufacturing semiconductor devices, the apparatus comprising:

a container having a first portion and a second portion;

a diffuser between the first and second portions;

an input port in the first portion of the container;

a mixing device in the first portion of the container; and an output port in the second portion of the container.

* * * * *